US006500055B1

(12) United States Patent
Adams et al.

(10) Patent No.: US 6,500,055 B1
(45) Date of Patent: Dec. 31, 2002

(54) OSCILLATING ORBITAL POLISHER AND METHOD

(75) Inventors: John A. Adams, Escondido, CA (US); Everett D. Smith, Escondido, CA (US); Stephen C. Schultz, Gilbert, AZ (US)

(73) Assignee: SpeedFam-IPEC Corporation, Chandler, AZ (US)

( * ) Notice: Subject to any disclaimer, the term of this patent is extended or adjusted under 35 U.S.C. 154(b) by 0 days.

(21) Appl. No.: 09/664,125

(22) Filed: Sep. 18, 2000

Related U.S. Application Data

(62) Division of application No. 09/153,993, filed on Sep. 17, 1998, now Pat. No. 6,184,139.

(51) Int. Cl.[7] ..... B24B 1/00

(52) U.S. Cl. ..... 451/270; 451/291; 451/286; 451/288

(58) Field of Search ..... 451/41, 60, 166, 451/173, 162, 270, 287, 289, 53, 291; 438/692–693

(56) References Cited

U.S. PATENT DOCUMENTS 4,630,401 A * 12/1986 McNeil ..... 451/113
4,676,027 A * 6/1987 McNeil ..... 451/113
5,196,353 A 3/1993 Sandhu et al.
5,232,875 A 8/1993 Tuttle et al.
5,389,579 A 2/1995 Wells
5,514,245 A 5/1996 Doan et al.
5,554,064 A 9/1996 Breivogel et al.
5,560,802 A 10/1996 Chisholm
5,609,718 A 3/1997 Meikle
5,697,832 A * 12/1997 Greenlaw et al. ..... 451/290
5,762,544 A 6/1998 Zuniga et al.
5,865,666 A 2/1999 Nagahara
5,899,800 A 5/1999 Shendon
5,938,507 A 8/1999 Ko et al.
5,951,373 A 9/1999 Shendon et al.
5,957,754 A 9/1999 Brown et al.
5,957,764 A 9/1999 Anderson et al.
5,989,107 A 11/1999 Shimizu et al.
6,184,139 B1 * 2/2001 Adams et al. ..... 438/691

OTHER PUBLICATIONS

Beachem, "Chemical Mechanical Polishing: The Future of Sub HalfMicron Devices," (Nov. 15, 1996, downloaded from the Internet on Jun. 22, 1998).
"The World's Most Popular, Fully Automated CMP Tool," IPEC CMP Equipment, Avanti 471 (downloaded from the IPEC Website on Jun. 22, 1998).
"Introducing the AvantGaard 776, The World's Most Advanced CMP Technology," IPEC CMP Equipment, AvantGaard 776 (downloaded from the IPEC Website on Jun. 22, 1998).
"System Highlights, Introducing the AvantGaard 676," IPEC CMP Equipment, AvantGaard 767 (downloaded from the IPEC Website on Jun. 22, 1998).

* cited by examiner

*Primary Examiner*—George Nguyen
(74) *Attorney, Agent, or Firm*—Snell & Wilmer, L.L.P.

(57) ABSTRACT

A method and apparatus for improving uniformity of the rate of removal of material from the surface of a semiconductor substrate by chemical mechanical polishing. In accordance with the invention, the semiconductor substrate is subjected to a combination of polishing motions, including orbital motion, and at least one additional polishing motion selected from rotational, oscillating, sweeping, and linear polishing motions. The invention also provides an improved method for conditioning polishing pads to provide more uniform conditioning and to extend their useful life span.

6 Claims, 7 Drawing Sheets

OSCILLATING ORBITAL POLISHER AND METHOD

CROSS-REFERENCE TO RELATED APPLICATIONS

This application is a divisional of U.S. application Ser. No. 09/153,993, filed Sep. 17, 1998, now U.S. Pat. No. 6,184,139.

FIELD OF THE INVENTION

The invention relates to integrated circuit manufacturing technology, and more specifically, to processes for planarizing surfaces of wafer-type semiconductor substrates, such as semiconductor wafers, through chemical mechanical polishing.

BACKGROUND OF THE INVENTION

Photolithographic optics-based processes are used in the manufacture of integrated circuits, and since these processes require accurate focusing to produce a precise image, surface planarity becomes an important issue. This is becoming increasingly critical as line widths are being reduced in size in order to make semiconductor devices even more compact, and to provide higher speeds. More accurate optical focusing for finer line widths results in a loss of "depth of field" (i.e., the focusing is very accurate only in a plane of very limited depth). Accordingly, a planar surface is essential to ensure good focusing to enable the photolithographic process to produce fine line width, compact high speed semiconductor devices.

There are several techniques for planarizing the surface of a semiconductor wafer. One of these is chemical mechanical polishing (CMP). As indicated in an article entitled "Chemical Mechanical Polishing: The Future of Sub Half Micron Devices,"Dr. Linton Salmon, Brigham Young University (Nov. 15, 1996), CMP is now considered the most effective method yet for planarizing wafers with sub micron lines. In this process, a wafer is mounted on a rotary carrier or chuck with the integrated circuit side facing outward. A polishing pad is then brought into contact with the integrated circuit side. Pressure may be applied by the carrier and/or the platen to effectuate polishing. According to Salmon, in some CMP machines the wafer rotates while the polishing pad is stationary, in others the pad rotates while the wafer carrier is stationary, and in yet another type both the wafer carrier and the pad rotate simultaneously. The polishing pad may be pre-soaked and continually re-wet with a slurry that has a variety of abrasive particles suspended in a solution. Typically, the particles range in size from 30 to 1,100 nanometers. After planarization through polishing, the wafers go through a post-CMP clean up to remove residual slurry, metal particles, and other potential contaminants from its surface.

An important variable in planarization through CMP is "removal rate" which is the rate of removal of material from the surface of the semiconductor wafer being polished. Preferably, the rate of removal should be such that any surface peaks are preferentially flattened and the resultant surface should be as near perfectly planar as possible. There are several factors that may affect the rate of removal. For example, the nature of the slurry can have a dramatic effect. The slurry includes abrasive particles suspended in a solvent which selectively may soften certain features of the pattern on the semiconductor wafer surface, thereby affecting the relative rate of removal of those features vis-à-vis others. As indicated in the above article, "The purpose of the slurry is simple, yet understanding and modeling all the mechanical and chemical reactions involved is nearly impossible." Accordingly, development of the CMP process has proceeded on a "trial and error basis."

Among the more advanced CMP machines presently available are the AvantGaard Model 776 of IPEC of Phoenix, Ariz. In this CMP apparatus, the lower head (containing the polishing pad) orbits, while the carrier holding the wafer rotates about a central axis. Polishing fluids (slurry) are introduced to the wafer directly through the polish pads with point-of-use mix, which results in better wafer uniformity and reduced slurry consumption.

There continues to be multiple challenges in CMP, making the polishing and planarization faster, more uniform across a wafer, and improving the variation seen in wafer to wafer results. The polishing motion of the pad and carrier play a crucial role in the CMP process along with the quality of the polishing pad over its life.

The polishing pad should be "conditioned" after a period of use to provide for a more uniform polishing rate, from wafer to wafer, and to provide for better planarization uniformity across a single wafer. During the pad conditioning process, a pad conditioner arm with an abrasive lower surface is forced to come in contact with the pad upper surface while the pad oscillates and the conditioner arm moves back and forth in an arc about a pivot axis outside of the circumference of the polish pad. The combined pad oscillation and the conditioning arm arc motion during conditioning results in non-uniform pad surface removal and roughing. Areas closer to the arm arc pivot are conditioned at a higher rate than the areas more distant from the arc pivot. Over time, this non-uniform pad conditioning results in poorer polishing uniformity on the semiconductor wafers.

Semiconductor manufacturers consistently require CMP processes to improve over time. As semiconductor devices become ever more complex and device geometry becomes ever so much smaller, there exists a need to make the CMP removal rate more consistent from wafer to wafer and wafer lot to wafer lot, while also making the polishing results more uniform across the entire surface of a wafer. Furthermore, there is also a need for a method to provide better and more uniform conditioning of CMP pads during their lifetime.

SUMMARY OF THE INVENTION

The invention provides a method of improving the uniformity of the rate of removal of material from the surface of a semiconductor substrate, such as a wafer having integrated circuits formed thereon. The invention also provides a method for better and more uniform conditioning of chemical mechanical polishing (CMP) pads to extend the useful lifetime.

The objective of the invention is achieved through use of a combination of polishing motions applied to the surface of the semiconductor substrate or cleaning motions applied to the polishing pad. These motions are selected from combinations of the following: rotational, orbital, oscillating, sweeping and linear movement. As explained in more detail herein, the combination of motions may be achieved through permutations of movement of the polishing platen and wafer carrier, in the case of semiconductor substrate surface polishing; and through permutations of the movement of the polishing pad and conditioning surface, during polishing pad conditioning.

In accordance with one embodiment of the method of the invention, a wafer held in a carrier (which may rotate about a central axis, or which may be stationary) is brought into contact with a polishing pad that is rotating or oscillating (i.e., at least partially rotating in alternating directions) about its central axis, while the pad is simultaneously orbiting around an orbital axis. The clockwise and counter-clockwise rotational oscillations of the polishing pad about its central axis may range through angles of less than 360 degrees to more than 360 degrees in each direction. Continuous rotation of the polishing pad about its central axis may also be imparted in certain embodiments to improve the surface characteristics of the semiconductor wafer. The wafer carrier may be rotated or oscillated about an axis or held stationary. A polishing slurry is applied, either through the pad itself or through distribution onto the pad to allow infiltration between the pad and the wafer surface being polished. The polishing is maintained while applying a sufficient pressure to polish the semiconductor wafer surface to a desired degree of planarity.

In accordance with another embodiment of the method of the invention, a wafer held in a carrier is brought into contact with a polishing pad that is moving linearly, relative to the wafer surface. The wafer carrier on the other hand both orbits about an axis, and oscillates about a second axis, offset from the first axis. Alternatively, the polishing pad may rotate about a central axis.

The current embodiment of the invention also provides an apparatus for polishing semiconductor wafers to planarize the surfaces of the wafers. The apparatus includes a carrier adapted for securely holding at least one semiconductor wafer to expose the back surface of the wafer to be polished on an underside of the carrier, and the front surface of the wafer to be polished to a polishing pad, supported on a platen, spaced from the carrier underside. But one with ordinary skill in the art could orient the apparatus such that the carrier was below the platen. The apparatus includes mechanical means for imparting orbital motion to the platen. Such means, for example, may include a stacked pair of rotary bearings with an upper bearing fixedly mounted to the platen and an upper portion of a cylindrical sleeve, that has central axes in its upper and lower portions offset from each other, extending vertically below the platen. A lower bearing is mounted to the lower portion of the cylindrical sleeve and housing of the apparatus, such that the axes of rotation of the bearings are offset. A drive motor rotates the sleeve, thereby causing the platen to orbit about an orbital axis. The apparatus of the invention further includes a shaft having a first end coupled to the platen supporting the polishing pad, and a second end coupled to means for imparting rotating or oscillating motion to the shaft. These means may include, for example, a drive motor with a gear box to rotate the shaft and a motor controller to control degrees of rotational output of the motor. Alternatively, a mechanical stop means may limit the arc of rotation of the shaft, and an electrical stop may reverse oscillatory motion of the shaft when the stop has been reached. Other mechanical devices for controlling degrees of shaft rotation or oscillation are clearly also useful. The wafer carrier may be rotated or oscillated about its axis by suitable means, or remain stationary.

The invention also provides an apparatus in which the wafer carrier undergoes orbital and rotational motion, or orbital and oscillating motion; while the pad in contact with the semiconductor substrate held in the carrier either rotates, or is held stationary. In accordance with this apparatus, the mechanical means for imparting orbital and rotational or oscillating movement to the carrier substantially corresponds to the above-described apparatus for imparting such motion to the platen. The platen holding the polishing pad, in accordance with this embodiment, has a central shaft that may be rotated at a controlled rate by an electrical motor, or maintained stationary. Thus, a substrate held in the wafer carrier has a surface subjected to potentially one of four types of permutations of polishing motion: (1) orbital and rotational (with platen stationary); (2) orbital and rotational and sweeping (with platen rotating); (3) orbital and oscillating (with platen stationary); and (4) orbital, oscillating, and sweeping (with platen rotating).

In a yet further embodiment of the invention, the pad is a continuous belt mounted over a pair of rollers, and has a backing slide plate to allow pressing of the belt pad against a semiconductor substrate held in a wafer carrier. In this embodiment, the wafer carrier is able to produce orbital motion, and either oscillating or rotational motion. Thus, when the continuous belt is driven linearly, the surface of the semiconductor substrate is subjected to one of the following two polishing motions: (1) a combination of orbital oscillation and linear movement; and (2) a combination of orbital, rotational and linear polishing movement.

Using the apparatus of the invention, and applying the method of the invention, semiconductor wafers are produced that are more planar across the entire surface area, than wafers that are polished without the rotary or oscillatory motion of the invention. The removal rate of the method and apparatus of the invention is more uniform across the wafer.

The invention also provides, through the at least partial rotational movement and simultaneous orbital movement of the pad, a method for improving pad conditioning. Usually, as explained before, in the prior art pad conditioning process, a pad conditioner arm with an abrasive lower surface is brought into contact with the pad upper surface while the pad oscillates and the conditioner arm moves back and forth in an arc about a pivot axis outside of the circumference of the polish pad. The combined pad oscillation and the conditioning arm motion during conditioning results in non-uniform pad surface removal and roughing. Over time, this non-uniform pad conditioning results in poorer polishing uniformity on the semiconductor wafers. In accordance with the invention, the rotation or oscillation of the pad greatly enhances the conditioning process by allowing the areas that ordinarily are less conditioned in the prior art to move into regions of higher conditioning while the more heavily conditioned areas move into the regions of lower conditioning. Thus, uniform conditioning across the pad may be achieved through the invention.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings which are schematic and not to scale, wherein.

DETAILED DESCRIPTION OF THE PREFERRED EMBODIMENT

U.S. Pat. No. 5,554,064 entitled "Orbital Motion Chemical-Mechanical Polishing Apparatus and Method of Fabrication," discloses an orbital chemical-mechanical polishing apparatus, and is hereby fully incorporated by reference. The apparatus of the present invention adds an additional type of motion to the polishing pad of the apparatus: namely, rotation or oscillation achieved by rotating the platen with its polishing pad, in the preferred embodiment, in alternating clockwise and counterclockwise directions. These rotations or oscillations of the platen with its polishing pad during CMP enhance the polished wafer surface by reducing polish variations as compared to a surface obtained using orbital motion only.

Figure 1:
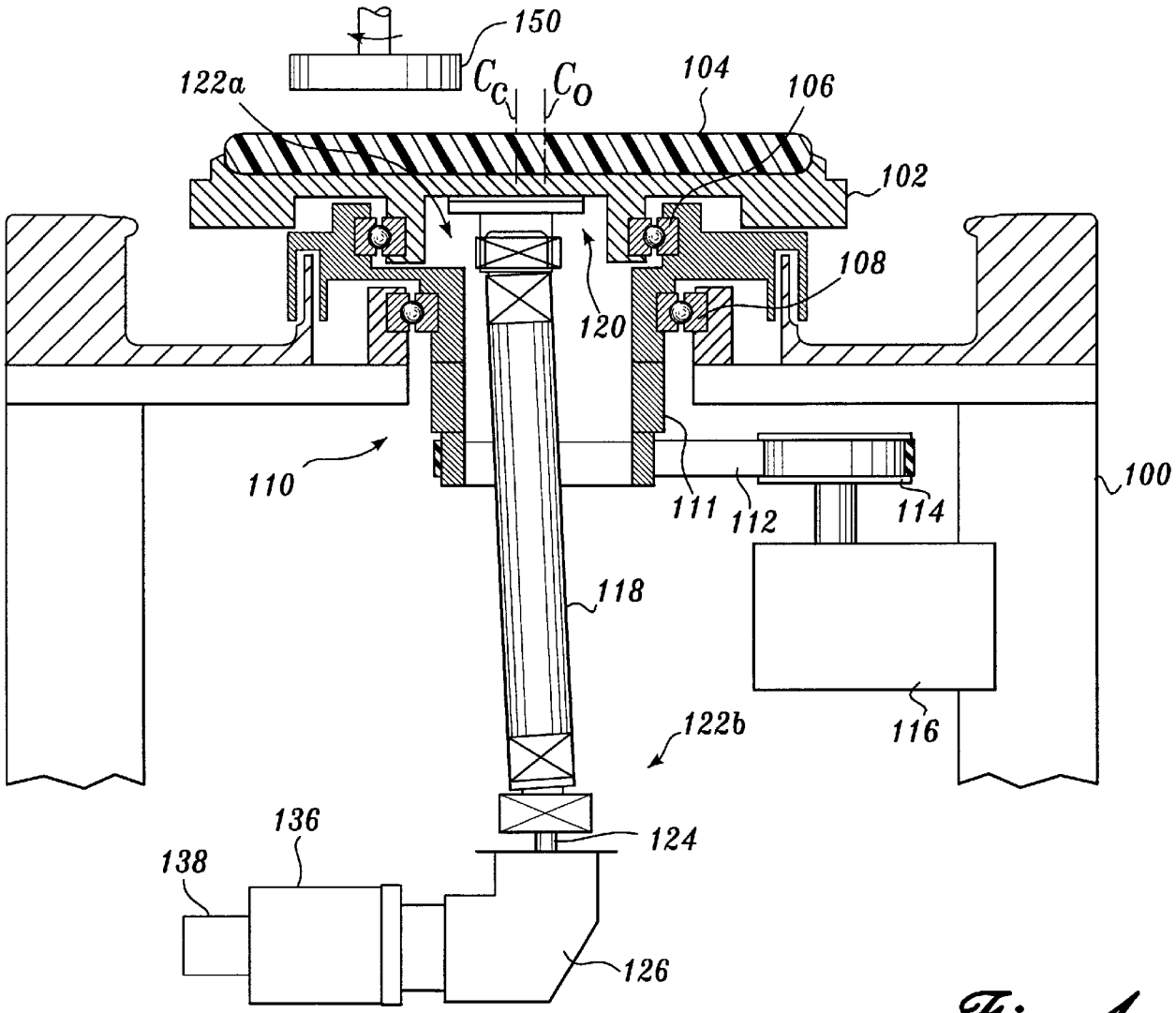
FIG. 1 is a schematic partial side view in cross section of a preferred embodiment of the apparatus of the invention.

Referring to FIG. 1, the preferred embodiment of the apparatus of the current invention, the apparatus includes a frame 100 onto which is mounted a platen 102 that is equipped with a polishing pad 104.

The apparatus includes a pair of rotary bearings, the upper rotary bearing 106 is fixedly mounted to an underside of the platen 102, and a rotatable "wave generator" 110 that includes a substantially cylindrical sleeve 111 extending downward under the platen 102. A first central axis Co of the upper rotary bearing 106 of the wave generator 110 is offset from the second central axis Cc of the lower rotary bearing 108. The lower rotary bearing 108 is fixedly mounted to the lower portion of the sleeve 111, and to the supporting frame 100 of the apparatus. Thus, when the wave generator 110 is brought into rotational motion, the first central axis Co orbits about the second central axis Cc of the lower rotary bearing 108 at a rate equal to the rotation rate of the wave generator 110. The radius of orbit of the first central axis Co of the upper rotary bearing 106 is equal to the parallel offset between the first central axis Co and the second central axis Cc. This causes the platen 102 and pad to orbit. As indicated in FIG. 1, rotary motion is imparted to the wave generator 110 by means of a drive belt 112 that embraces sleeve 111 and that extends over a pulley 114 coupled to a drive motor 116. More detail about the orbital motion is found in U.S. Pat. No. 5,554,064 previously incorporated by reference.

According to the invention, a shaft 118 extends from an underside of the platen 102 where it is fixedly attached, through the annular space of the sleeve 111 of the wave generator 110 downward to a mechanism for imparting rotary or oscillatory motion to the platen 102. The shaft 118 includes an upper pedestal 120 fixedly attached to the underside of the platen 102. Extending downward from the pedestal 120, the shaft includes an upper universal joint 122*a* and a lower universal joint 122*b*, spaced from the upper universal joint 122*a*.

A variety of mechanisms that may be used to impart rotational or oscillatory motion of the invention will become clear to one of skill in the art who has read this disclosure. In the preferred embodiment of FIG. 1, a drive shaft 124 is coupled to the lower universal joint 122*b* at one of its ends, and to gear box 126 at its other end. The axis of drive shaft 124 is along the same axis of rotation of the second center axis Cc of the lower rotary bearing. The gear box is driven by a step motor 136, that is controlled by a motor controller 138. The motor controller controls the degree of rotation imparted by the motor to shaft 124. Thus, by adjusting the motor controller, the arc may be varied within the range from about −360 to about +360 degrees for oscillatory motion. For rotational motion, the motor may be allowed to continuously rotate shaft 124 thereby causing continuous rotation of pad 104.

Figure 2:
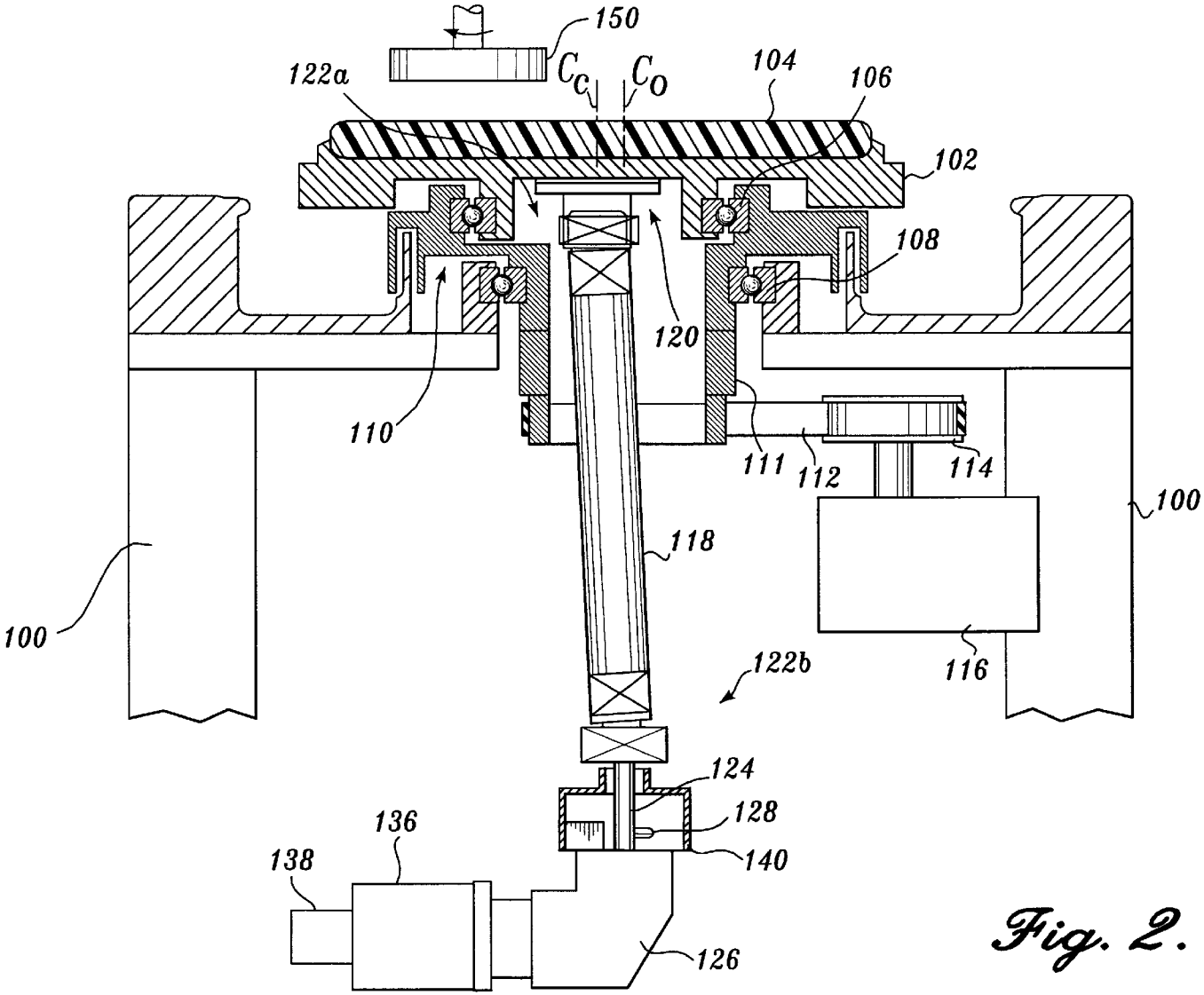
FIG. 2 is a schematic partial side view in cross section of another embodiment of the invention.
Figure 3:
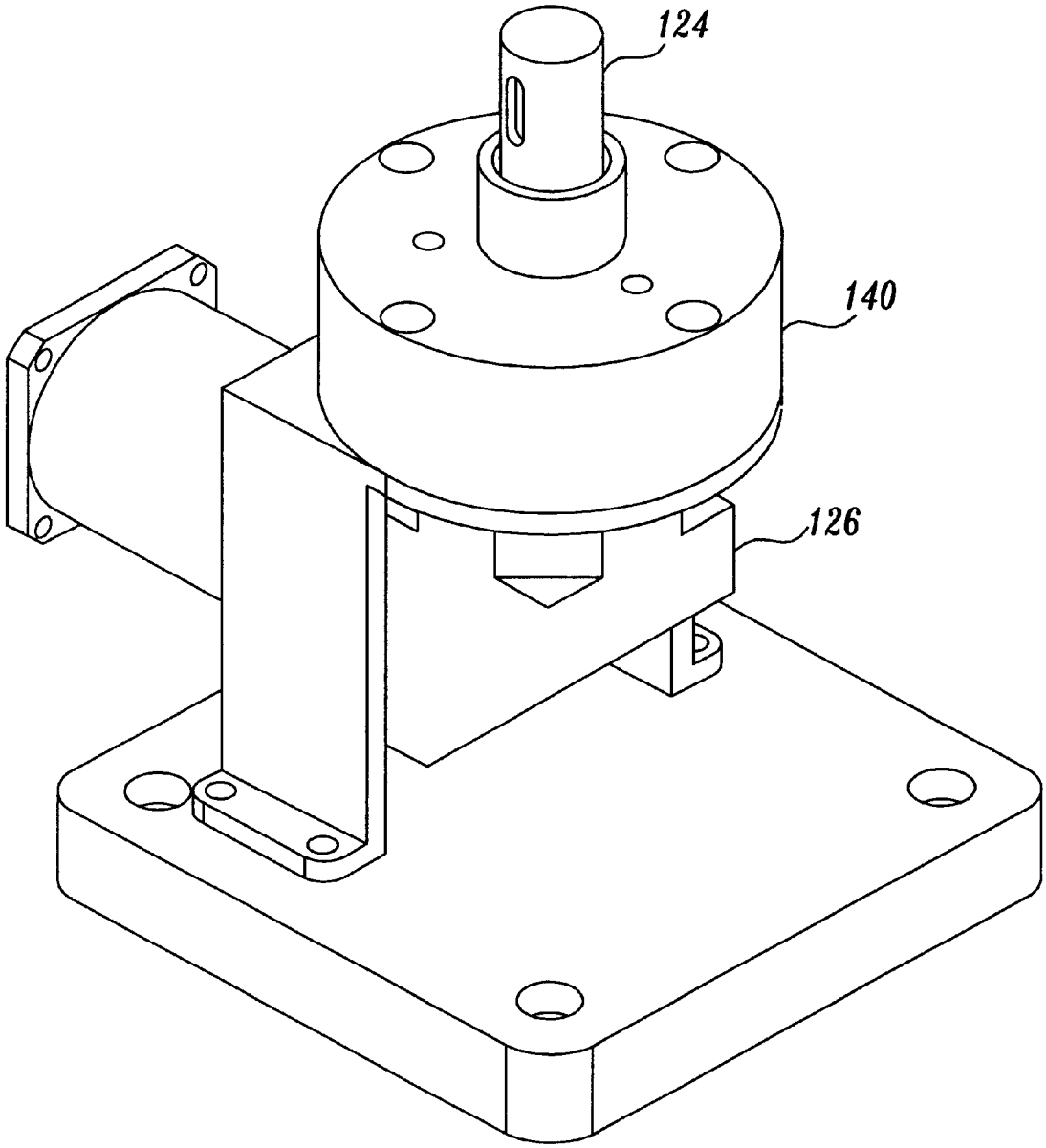
FIG. 3 is a perspective view of the apparatus required to impart oscillatory motion to an orbiting platen, in accordance with the embodiment of the invention of FIG. 2.
Figure 4:
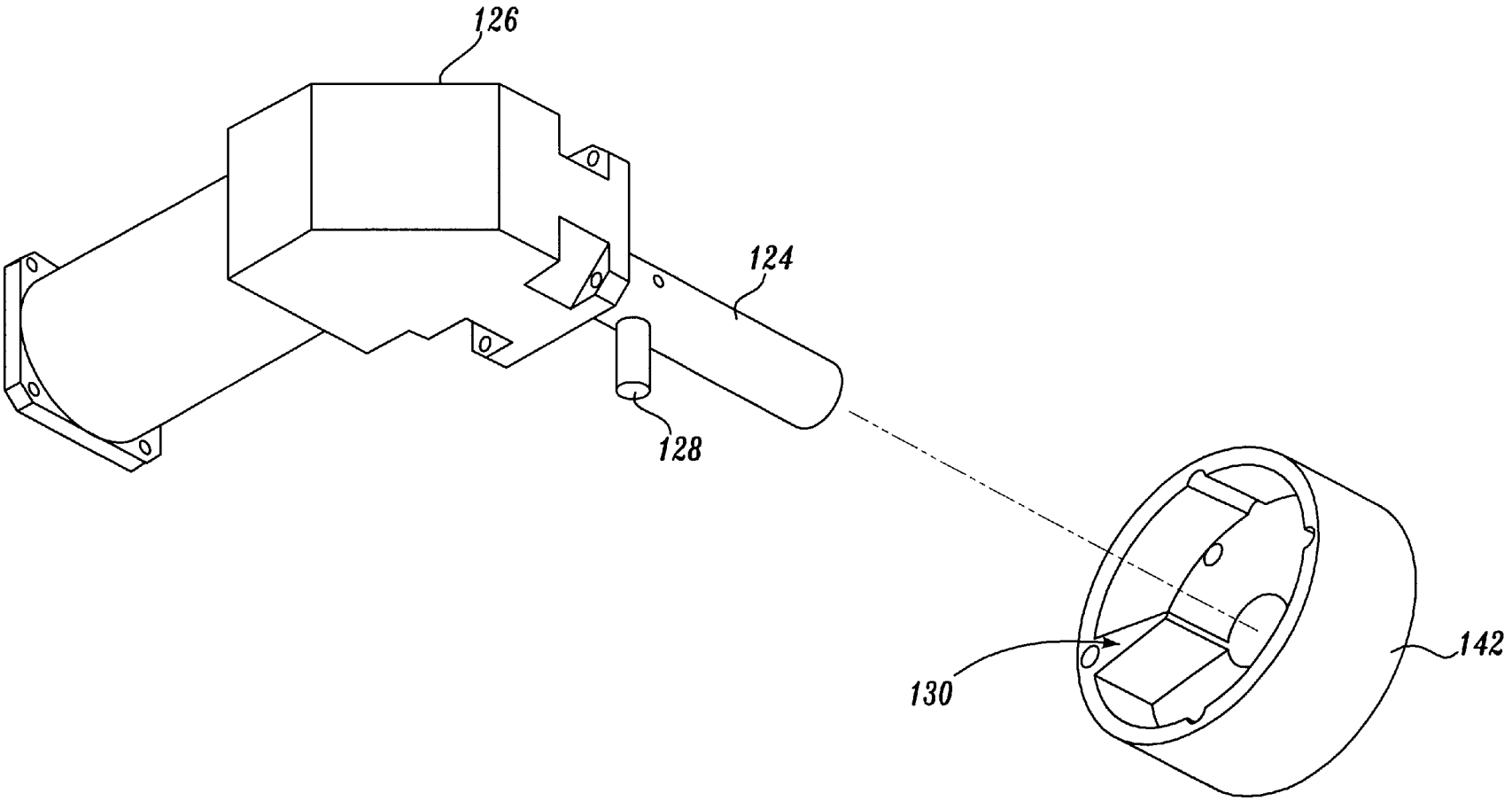
FIG. 4 is a schematic partially exploded view showing mechanical stop details of an embodiment of the invention of FIG. 3 for providing oscillatory motion to an orbiting platen.

Other mechanisms may also be utilized to impart oscillatory (partial rotational movement) or rotational movement to the pad 104. For example, in the alternative embodiment of the invention shown in FIG. 2, oscillatory motion is produced by a combination of a drive motor and mechanical and electrical stops that cause the shaft to move in alternate counterclockwise and clockwise motion, limited by the mechanical stop. Thus, referring to FIGS. 2, 3, and 4, a substantially vertical shaft 124 is coupled to and extends downward from below the lower universal joint 122*b*, and into a hard stop box 140. As shown, the shaft 124 has a radial leg 128 that sweeps the interior of surrounding cap 142 when the shaft 124 is rotated. To limit rotation of shaft 124, one or more mechanical stops are placed in the cap 142 to arrest rotational movement of the shaft by blocking movement of the radial leg. A pair of electrical sensors or stops (not shown) are located on the outside of each side of the mechanical stop 130 so that the radial leg 128 will encounter the electrical stops before being blocked by the mechanical stop.

A motor 136, able to impart rotary motion, is mounted to a supporting frame 100 of the apparatus, and is mechanically coupled to the gear box 126. Thus, the motor 136 through gear box 126 rotates shaft 124 and, hence, shaft 118 counterclockwise, thereby causing the platen to rotate in the same direction, until the radial leg 128 of the shaft 124 is stopped by the mechanical stop 130. Then, due to electrical contact with electrical sensor 132, direction of rotation is reversed to a clockwise direction. Again, shaft 118 and platen 102 also rotate clockwise until the radial leg 128 of shaft 124 is limited by mechanical stop 130. Contact with the other electrical stop 132 causes reversal of the rotational movement, as described above. Thus, the apparatus provides clockwise and counterclockwise oscillatory movement in an arc determined by the location of the mechanical stop.

As explained above, in accordance with the invention, the pad is simultaneously subject to at least partial rotational movement and orbital movement. For complete rotational movement, in those apparatus where the supply of polishing slurry is applied through the pad, the slurry supply lines (and any other supply lines) should be supplied with rotatable couplings so that the supply lines do not twist around the shaft. Obviously, for partial rotational movement or oscillation, such rotational couplings may not be needed, as long as the supply lines are of adequate length.

In a preferred embodiment of the invention, developed for polishing standard 8 and 12-inch wafers, the platen and pad orbit such that the locus of the center of the pad describes a circle with a diameter from about ½ of the wafer diameter to about 0.1 inches with the preferred orbit diameter of 1.25 inches. The center of orbit of the carrier is offset from the center of the orbit of the platen by from about 0 to about 1 inch with a preferred offset of about ⅜ inches.

Typically, in accordance with the invention, the pad and platen orbit at speeds of at least 300 revolutions per minute, more preferably in the range 300–600 revolutions per minute, but the range can be as much as 200–2000 revolutions per minute. The wafer carrier 150 may rotate or oscillate about its axis or remain stationary.

In accordance with the invention, it is preferred that the polishing pad be rotated or oscillated an integral number of times during each polish cycle. The duration of a polish cycle depends upon several factors, and typically varies in the range from about one to about four minutes. It is preferred to have from about 1 to about 6 complete oscillations per polish cycle.

While the arc through which the polish pad 104 rotates or oscillates may vary, it is preferred to oscillate continuously. It should preferably be able to oscillate through the range from about −180 degrees (counterclockwise) to about +180 degrees (clockwise). Oscillatory motion in the region from about −135 degrees to about +135 degrees is useful, but lesser or greater angular rotation may also be beneficial.

It will be readily apparent that in the above embodiment of the apparatus of the invention, the surface of a semiconductor substrate being polished may be subjected to a combination of several kinds of motion, depending upon mode of operation of the apparatus. For example, when the platen both orbits and oscillates, and the wafer carrier rotates, the wafer surface is subjected to orbital, rotational and oscillating polishing movement. On the other hand, when the platen orbits and rotates, while the wafer carrier rotates, the wafer surface is subjected to orbital polishing movement along with two kinds of rotational polishing movement. When the wafer carrier is stationary, the wafer surface is subjected to either orbital and rotational polishing movement, or orbital and oscillating polishing movement, depending upon mode of operation of the apparatus. In accordance with term usage of this document, "an oscillating polishing movement" refers to movement of the device (carrier or platen) and not the actual movement experienced (or traced) by a locus on the wafer surface; the same applies to "linear", "rotational", "sweeping" and "orbital polishing movements".

Figure 5:
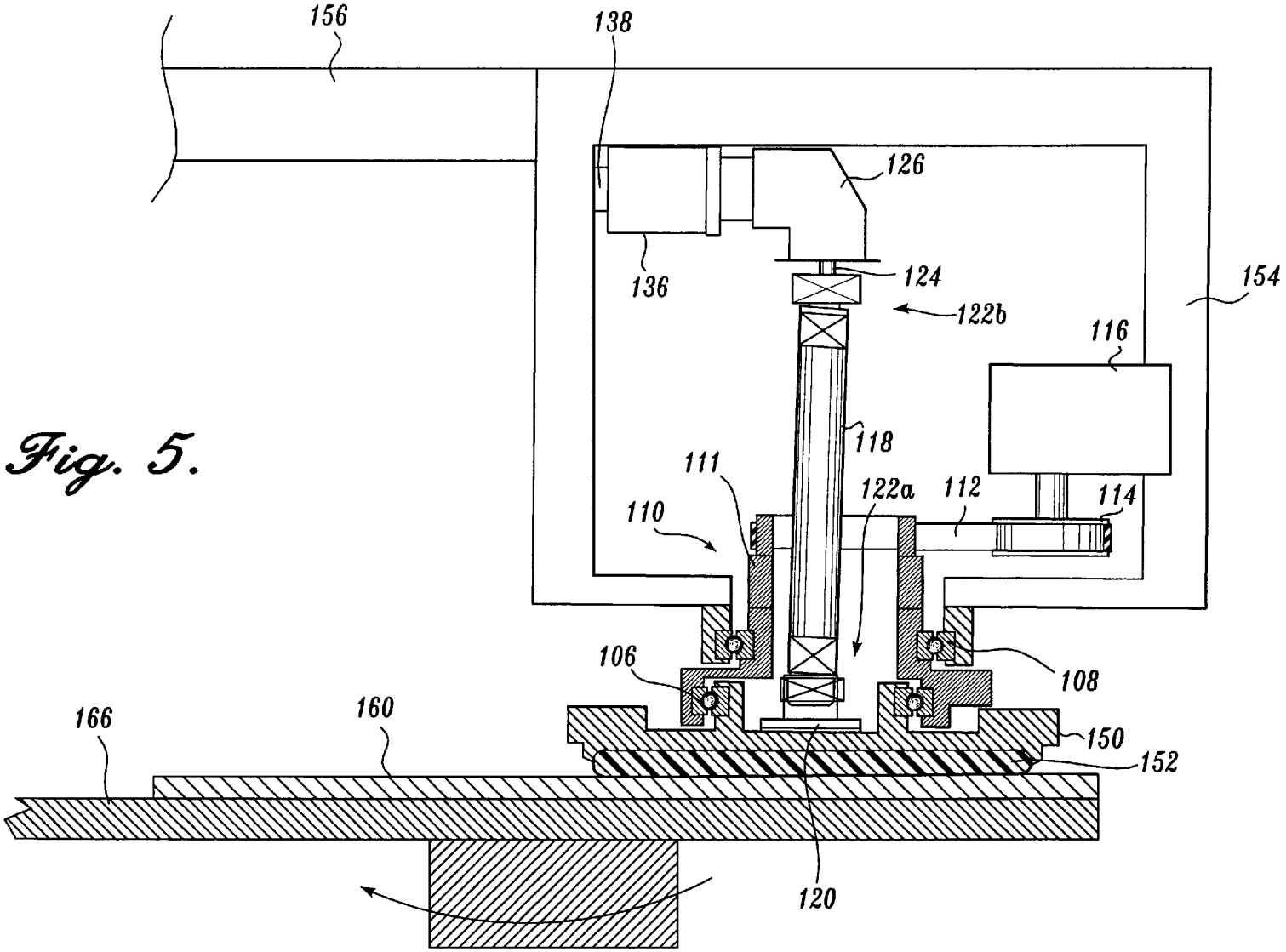
FIG. 5 is a schematic illustration showing a side view, in partial cross-section to show details of an alternative embodiment of the invention, wherein a wafer carrier is equipped to both oscillate and orbit, or rotate and orbit, against a polishing pad that is either stationary or rotating.

It will be readily apparent to one of skill in the art who has read this disclosure, that mode of movement of the carrier and platen can be reversed, i.e., the wafer carrier may be equipped with mechanical means to generate orbital and either oscillating or rotational movement; while the platen may be retained stationary or may rotate. Accordingly, the invention also provides an apparatus for carrying out this "reverse" application of polishing movement, through the embodiment illustrated in FIG. 5. Since many of the component parts of the apparatus are similar to that of the above-described embodiment, the same numerals are used for simplicity. In this instance, the wafer carrier 150 is linked to a wave generator 110, that is similar to the wave generator described above in that it is comprised of two bearings 106, 108 spaced vertically from each other, and with centers of rotation offset. The lower bearing 108 is mounted to a support structure, such as the housing 154, which is in turn supported by a support structure 156. One end of the wave generator has a cylindrical sleeve 111 which is driven by a belt 112 that passes over a drive pulley 114 of an electrical motor 116 which preferably has speed control. Once again, a central shaft 118 extends in the annular space of the wave generator and the pedestal 120 at its lower end is mounted to the upper surface of the wafer carrier 150. The shaft 118 is equipped with at least two universal joints, 122*a* and 122*b*, one at each of its ends. A drive shaft 124 is mounted to an upper end of the shaft 118, above the upper universal joint 122*b*, and is driven through gear box 126 by motor 136 which is in turn controlled by motor controller 138. Thus, the apparatus for imparting orbital and rotational or oscillating movement to the wafer carrier 150 is similar to the apparatus described above for imparting such motion to the polishing pad platen.

In this instance, the wafer carrier, when it contains a wafer 152, is brought into contact with the pad 160 which is supported on platen 166, which may rotate or which may be held stationary. When the platen rotates, the pad sweeps across the face of the wafer being polished in a "sweeping motion." At the same time, operation of the above-described apparatus imparts an orbital motion to the wafer carrier (and hence to the wafer) along with either complete rotation of the carrier around its central axis, or oscillation about that access. Thus, the apparatus provides for several permutations of polishing movement on the surface of the wafer: (1) orbital, rotational and sweeping polishing movement; (2) orbital, oscillation and sweeping polishing movement; (3) orbital and oscillating polishing movement; and (4) orbital and rotational polishing movement.

Figure 6:
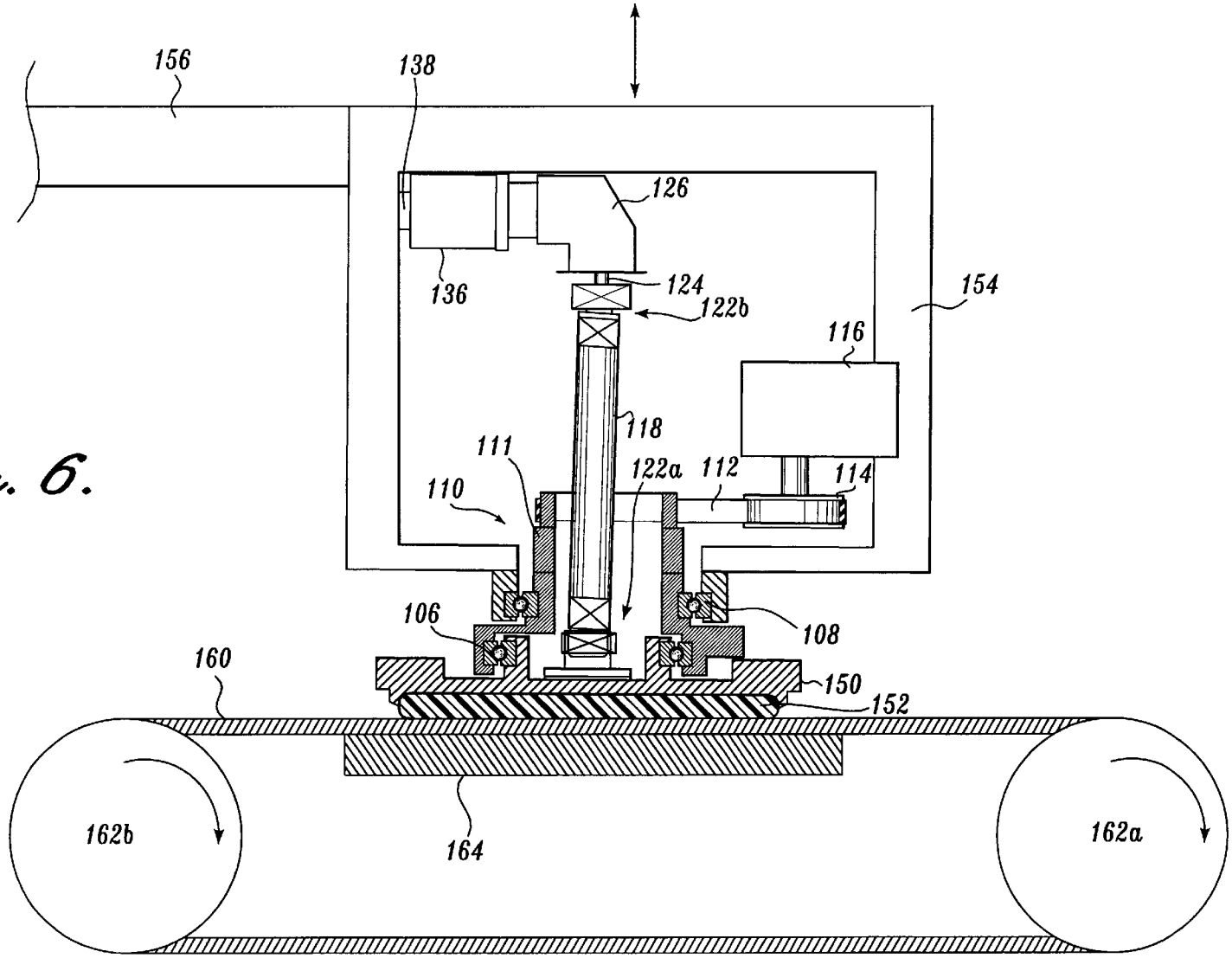
FIG. 6 is a schematic diagram, in partial side cross-section to show detail, illustrating an alternative embodiment of the invention, wherein the wafer carrier is equipped to either orbit and oscillate, or orbit and rotate; while the wafer is brought into contact with a continuous belt polishing pad that slides linearly across the surface of the semiconductor substrate.

The embodiment of FIG. 6 provides yet another variation of the above-described invention. In this instance, the polishing pad is in the form of a continuous belt 160 that passes over to rollers 162*a* and *b*, one of which is a drive roller. Thus, the polishing pad moves linearly relative to the wafer carrier 150 at a controlled rate. Preferably, the polishing pad moves at a rate of 100 to about 200 centimeters per second. The polishing pad is preferably backed with a rigid backing slide plate 164 that is mounted to a support the pad and allow controlled pressing of the wafer surface against the pad, without untoward yielding of the moving continuous belt pad 160. In accordance with this embodiment of the invention, a wafer surface being polished may be subject to rotational, orbital and linear polishing movement; or orbital, oscillation and linear polishing movement; or orbital and oscillation polishing movement; or orbital and rotational polishing movement.

Figure 7:
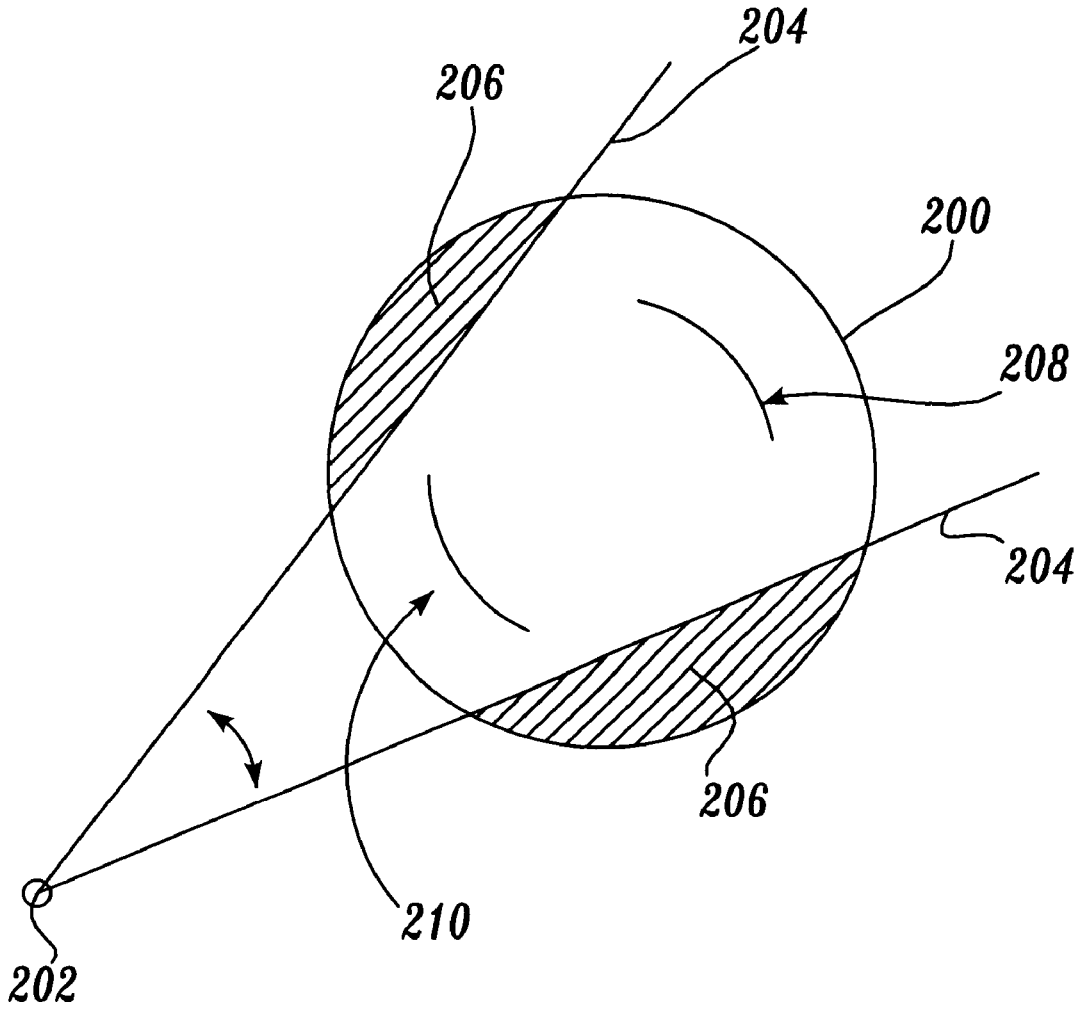
FIG. 7 is a schematic diagram to illustrate the polishing pad conditioning process.

In accordance with the invention, pad conditioning is also substantially improved and enhanced. As illustrated in FIG. 7, a polishing pad 200 is conditioned by a conditioning arm 204 that carries an abrasive conditioning surface and that pivots about point 202. In prior art, as a consequence of the motion of the arm in an arc and of the pad as it orbits, a lower conditioning region 208 arises at the locations farthest from the pivot point of the arm, and a higher conditioning region 210 arises at locations nearest the pivot point of the arm on the polishing pad. Moreover, in the prior art, two non-conditioned regions 206 may also arise. In accordance with the current invention, the entire pad is more uniformly conditioned. Due to oscillation or rotation of the polishing pad, those regions that may have been subjected to lower conditioning rotate to positions closer to the pad conditioner arm pivot and are then subjected to higher conditioning. Likewise, of course, those areas previously with high conditioning are then rotated to zones with lower conditioning. Thus, on the average, each region of the pad may be subjected to the same average conditioning. Accordingly, more uniform pad conditioning is obtained.

One skilled in the art may realize that it is the combinations of the respective motions that produces the desired results. The invention provides methods and apparatus which allow the selection of a range of permutations of polishing movement on the surface of a wafer being polished. Thus, the invention allows customization of polishing to meet specific requirements, and provides, for the first time, significant added flexibility to the operator to select polishing motion combinations for achieving the best result. Also, please note that the invention has been described in terms of a polish pad and a slurry with abrasive particles. The current invention will work equally as well with a slurryless pad, where the abrasive is embedded into the pad. Such pads are commercially available from 3M Products.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. An apparatus for polishing a surface of a semiconductor substrate, the apparatus comprising:

(a) a rotatable carrier adapted for securely holding the backside of at least one semiconductor substrate to expose a frontal surface of the substrate to be polished (b) a polishing pad supported on a platen spaced from the carrier;

(c) means for imparting orbital motion to the platen, the means comprising:

(i) a sleeve having mounted thereto a pair of rotary bearings, a first bearing of the pair mounted to the platen and the sleeve, the first bearing having a central axis offset from a central axis of a second bearing of the pair, the second bearing mounted to the sleeve and a support frame, and a drive motor to rotate the sleeve; and (ii) a shaft extending in an annular space of the sleeve having a first end mounted to an side of the platen opposite that supporting the polishing pad and a second end coupled to a means for at least partially rotating the shaft and the platen;

whereby during polishing, the pad is brought into contact with a wafer in the carrier under pressure while the carrier rotates and the pad both at least partially rotates about a central axis and orbits about an orbital axis offset from the central axis.

2. The apparatus of claim 1, wherein the means for at least partially rotating the shaft comprises a motor coupled to and driving a gear box, and a motor controller for the motor to control a degree of angular rotation of the shaft.

3. The apparatus of claim 1, wherein the means for at least partially rotating the shaft comprises a motor coupled to and driving a gear box, and a stop-limited shaft translating at least partial rotational motion from the gear box to the shaft in the annular space.

4. An improvement in an apparatus for polishing semiconductor wafers to planarize surface of the wafers, the apparatus comprising a pad mounted in a platen, the platen attached to mechanical means for causing the pad to orbit about an axis offset from a central axis of the pad, the pad spaced from a carrier for a wafer, the carrier coupled to a drive motor to rotate the carrier, and means for pressing a wafer in the carrier forcibly against the pad, the improvement comprising:

means, coupled to the platen and a drive motor, for at least partially rotating the platen in alternating clockwise and counterclockwise motion, when a semiconductor wafer is being polished and while the pad is in orbital motion.

5. The apparatus of claim 4, wherein the means for at least partially rotating the platen comprise a shaft having a first end mounted to the side of the platen opposite that supporting the pad, and a second end coupled through a universal joint to a motor-driven gear box assembly for at least partially rotating the shaft in alternating clockwise and counterclockwise motion.

6. The apparatus of claim 4, wherein the means for at least partially rotating comprises a shaft mounted at one end to a side of the platen opposite that supporting the pad with another end of the shaft coupled through a gearbox to a motor, the motor having a controller controlling angular rotation of the shaft.

* * * * *